United States Patent [19]

McLaughlin

[11] Patent Number: 4,490,943

[45] Date of Patent: Jan. 1, 1985

[54] WEATHERSTRIP FOR DOOR

[75] Inventor: James A. McLaughlin, Dedham, Mass.

[73] Assignee: Titanseal Corporation, Dedham, Mass.

[21] Appl. No.: 490,171

[22] Filed: Apr. 29, 1983

Related U.S. Application Data

[63] Continuation-in-part of Ser. No. 291,335, Aug. 10, 1981.

[51] Int. Cl.[3] ..... E06B 7/16

[52] U.S. Cl. ..... 49/478; 49/481

[58] Field of Search ..... 49/481, 478

[56] References Cited

U.S. PATENT DOCUMENTS

| | | | |
|---|---|---|---|
| 3,039,156 | 6/1962 | Morris, Jr. et al. | 49/481 |
| 3,221,375 | 12/1965 | Lewis et al. | 49/478 |
| 3,512,304 | 5/1970 | Meuret | 49/478 X |
| 4,192,101 | 3/1980 | White | 49/478 |

FOREIGN PATENT DOCUMENTS

| | | | |
|---|---|---|---|
| WO81/01166 | 4/1981 | PCT Int'l Appl. | 49/478 |

*Primary Examiner*—Kenneth Downey

*Attorney, Agent, or Firm*—Andrew F. Kehoe

[57] ABSTRACT

An improved weatherstripping door seal of the bellows type comprising an aluminum flange holding a polymeric bellows unit which helps shield the flange from contact with one opening a door.

5 Claims, 3 Drawing Figures

WEATHERSTRIP FOR DOOR

RELATED APPLICATION

This invention is a continuation-in-part of copending U.S. patent application Ser. No. 291,335 filed by James A. McLaughlin on Aug. 10, 1981.

BACKGROUND OF THE INVENTION

This invention is related to weatherstripping of the type which can be used on doors and windows in residential, commercial or industrial construction and, with particular advantage, in retrofitting a wide variety of conventional door constructions.

It has long been known in the art to provide magnetically-actuated door seals, particularly in refrigerator door construction. A positive seal is assured by having a first magnetic strip enclosed in a plastic or rubber sleeve which is, in turn, attached to an extensible means, such as a bellows. The magnetic strip then is attracted to a stationary magnetic strip on the door itself to effect a seal. The bellows provides the freedom of movement to assure a good seal along the door even if there is some bowing of the door because it has been forced shut or imperfectly assembled. There are many patents on such constructions. U.S. Pat. No. 3,465,536 illustrates a typical construction.

It is relatively easy to utilize such a seal effectively with relatively rigid constructions such as refrigerator doors. Moreover, such seals have been mounted on rigid structure for use in sealing thresholds (U.S. Pat. Nos. 3,469,349 and 3,512,304 also disclosed magnetic strip seals for doors intended for use in residential housing. Other door seal constructions of one type are disclosed in U.S. Pat. Nos. 3,039,156; 4,006,562; 4,192,101; and British Pat. No. 998,964. However, there has remained the need for a convenient and effective weatherstrip construction which can be used conveniently in retrofitting existing doors, especially those which are warped or one subject to warpage during changes in temperature and humidity.

It has been a particular need for a door seal of the metal-and-polymer type which is condensation-resistant and wears well without interfering with the convenient and comfortable operation of a door with conventionally-placed doorknobs.

SUMMARY OF THE INVENTION

A principle object of the present invention is to provide a door seal of the type using an extensible polymeric closure, e.g. of the bellows type, which is rugged and does not interfere with the comfortable opening of doors with conventionally-placed doorknobs.

Another object of the invention is to provide a condensation-resistant, metal-based door seal.

A further object of the invention is to provide a metal based door seal having the above attributes and which is readily sealable against door jambs in reasonably good repair and over a wide temperature range.

Other objects of the invention will be obvious to those skilled in the art on their reading of this application.

The above objects have been sustantially achieved by constriction of a door seal apparatus of the type comprising a polymeric extensible, bellows-type seal means adapted to seal with a mating seal surface and a rigit mounting flange from which said bellow extends the improvement wherein said rigid mounting flange comprises an arcuate cross section and extends from a first sealing foot forming means to seal against a door jamb and more remote from said bellows, to a support foot member perpendicular to said sealing foot in contact with said bellows structure, wherein said bellows member is mounted in said rigid mounting flange, and wherein said support foot member supports only that portion of a backwall of the bellows to which flexible webs of said bellow are attached, but wherein said support foot member is overlapped by a portion of said backwall.

Although the invention is disclosed with respect to a magnetic seal closure, it is particularly useful, too, with compression-gasket seal means as shown in FIG. 3.

ILLUSTRATIVE EMBODIMENTS OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for the purposes of illustration in order that others skilled in the art will more fully understand the invention and the principles thereof and will be able to modify it and embody it in a variety of forms, each as may be best suited to the condition of a particular case.

IN THE DRAWINGS

Figure 1:
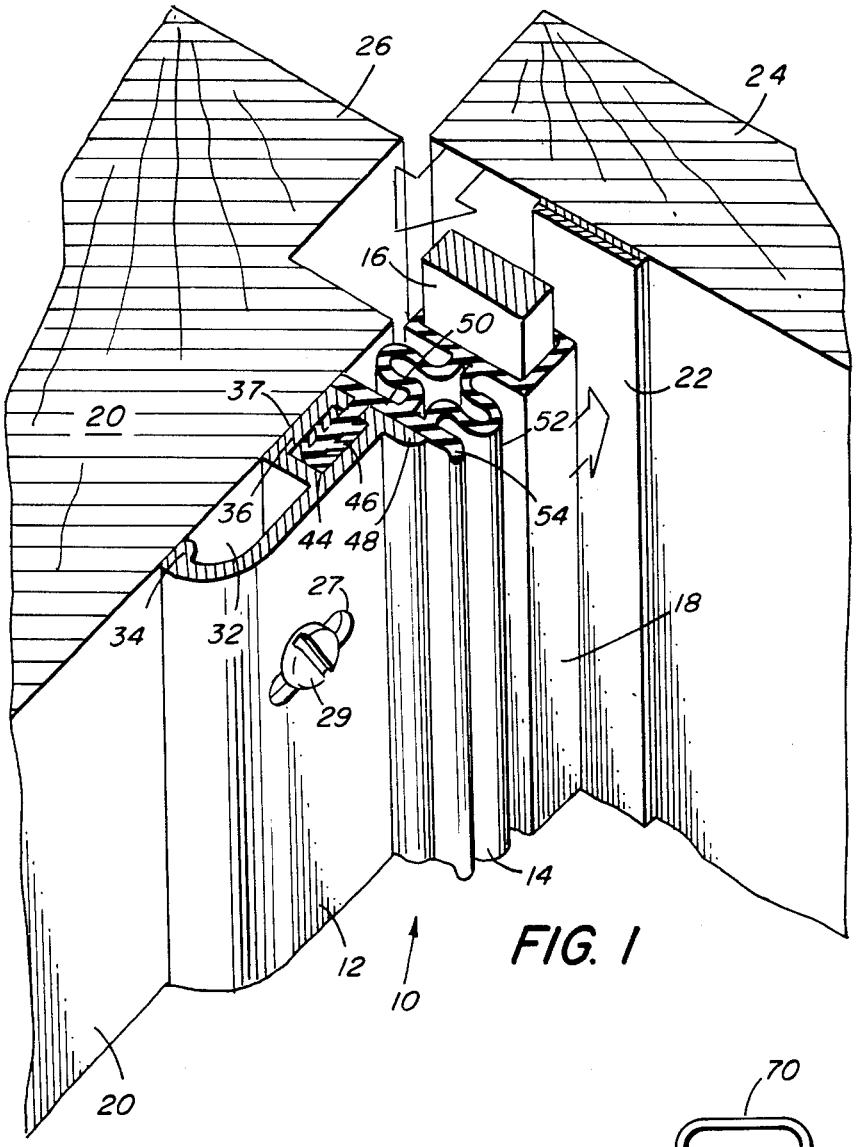
FIG. 1 is a perspective of the door seal of the invention shown mounted on a door jamb and used in conjunction with a magnetically-sealable closure system.

Referring to FIG. 1, it is seen that door seal assembly 10 comprises an aluminum mounting flange 12, a polymeric bellows member 14, a magnetic rod 16 insert within the sleeve 18 of bellows member 14. The flange is mounted on door jamb 20 and the magnet 16 is attracted by a strip magnet 22, mounted on door 24, to seal off any opening which might tend to exist between the door and the door frame 26 on closing of the door. Flange 12 has elongate mounting holes 27 for use in positioning and fastening the doorseal to a door jamb by screws 29 or other such fastening means. This general type of closure is known, but the following details will indicate how its novelty contributes those advantages which allow it to satisfy the objects of the invention.

The aluminum mounting flange comprises an arcuate flange 12 which is spaced from door jamb 20 by an airspace 32. Flange 12 curves at one end towards the door jamb and terminates in a first sealing foot member 34 which has a width approximately 50 to 100 percent thicker than the main body of the flange.

A channel 36 is molded into the flange structure to receive polymeric extensible seal means 40. Gasket 40 may be secured with a sealing means 44, as shown in FIG. 1, or securement may rely upon the compression within the channel of flexible baffles or fins 46 sometimes used in conjunction with such polymeric seals. Channel 36 also has an inner wall which is compressed against the door jamb and forms another sealing face therealong at 37.

An important aspect of the connection of flange 12 and bellows member 14 is the limited extension of foot member 48 of flange 12. It should extend outwardly from the main flange body far enough along the rear wall 50 of the bellows member such that it supports that member where each flexible bellow web 52 joins backwall 50. However, it should not extend any substantial amount further. This construction has been found to be particularly important in facilitating the use of a rugged durable metal-type flange with minimal danger of discomfort to the person opening a door with a conventionally-placed doorknob. Both the short-reach of member 48 and the flexible shielding extension 54 of the backwall 50 past foot member 48 contribute to this feature of the invention. The extension 54 also serves to protect the bellow from abuse by the knuckles of the door openener.

Another feature of the present construction is useful when the installation is against a cold, often metal, door jamb. The air channel formed by flange member 12 helps to reduce condensation on the main surface of the flange when the flange is placed on a very cold door jamb. Thus, although some benefits of the invention are realized using very hard plastic extrusions, i.e. the engineering plastics such as polycarbonates and the like, the principal advantages of the doorseals illustrated herein are realized when a metal like aluminum is used as the flange material.

Figure 2:
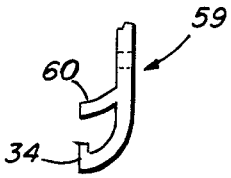
FIG. 2 is a fragmentary view from top of another door seal according to the invention comprising a secondary sealing rib.

FIG. 2 illustrates an alternate construction for the arcuate flange structure 59, one wherein a second sealing foot 60 is achieved for bearing against surfaces which may have random scratches or grooves, e.g. some older wood jambs.

Figure 3:
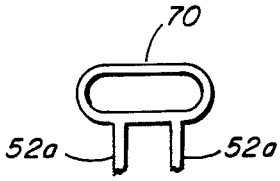
FIG. 3 is a section of a bellow-carried compression gasket useful as a seal with the apparatus of the invention.

Referring to FIG. 3, it is seen that a rubbery compression gasket 70 can be carried upon a bellows with extensible bellow webs 52*a*.

By "arcuate flange" is meant a flange which curves out from, as in the illustrated case, the door jamb. The arcuate shape need not be sustained throughout the length of the flange.

It is also to be understood that the following claims are intended to cover all of the generic and spcific features of the invention herein described and all statements of the scope of the invention which might be said to fall therebetween.

What is claimed is:

1. In a door seal apparatus of the type comprising a polymeric extensible, bellows-type seal means adapted to seal with a mating seal surface and a rigid mounting flange from which said bellow extends; the improvement wherein said rigid mounting flange extends from a first sealing foot forming means to seal against a door jamb and more remote from said bellows, to a support foot member perpendicular to said sealing foot in contact with said bellows structure, wherein said bellows member is mounted in said rigid mounting flange, and wherein said support foot member supports only that portion of a backwall of the bellows to which flexible webs of said bellow are attached, but wherein said support foot member is overlapped by a portion of said backwall.

2. A door seal apparatus as defined in claim 1 wherein said flange member is arcuate and said bellows is held in said flange member in a channel formed by said flange member and a second sealing foot mounted parallel to said arcuate flange member and forming a co-linear seal line with said first sealing foot.

3. Apparatus as defined in claim 1 wherein said rigid mounting flange is aluminum.

4. Apparatus as defined in claim 1 wherein said bellows is magnetically actuated.

5. Apparatus as defined in claim 1 wherein the bellows is attached to a compression-gasket sealing means.

* * * * *